US006609931B2

(12) United States Patent
Parrish et al.

(10) Patent No.: US 6,609,931 B2
(45) Date of Patent: Aug. 26, 2003

(54) ORIENTATIONLESS SQUIB CONNECTOR ASSEMBLY

(75) Inventors: Jeffrey David Parrish, Westland, MI (US); David James Rhein, Memphis, MI (US); Sheikh Habibur Rahman, Macomb Township, MI (US)

(73) Assignee: Tyco Electronics Corp., Middletown, PA (US)

( * ) Notice: Subject to any disclaimer, the term of this patent is extended or adjusted under 35 U.S.C. 154(b) by 0 days.

(21) Appl. No.: 10/037,120

(22) Filed: Oct. 25, 2001

(65) Prior Publication Data

US 2003/0082949 A1 May 1, 2003

(51) Int. Cl.[7] ..... H01R 9/05
(52) U.S. Cl. ..... 439/578; 439/108
(58) Field of Search ..... 439/578, 108, 439/98, 99, 668, 609, 579, 669, 696, 731, 695, 394, 825, 686, 687

(56) References Cited

U.S. PATENT DOCUMENTS

| | | | | |
|---|---|---|---|---|
| 5,131,680 A | | 7/1992 | Coultas et al. | 280/737 |
| 5,131,869 A | * | 7/1992 | Wharton | 439/662 |
| 5,200,574 A | | 4/1993 | Cunningham et al. | 102/530 |
| 5,241,910 A | | 9/1993 | Cunningham et al. | 102/530 |
| 5,273,457 A | | 12/1993 | Zell et al. | 439/581 |
| 5,314,345 A | | 5/1994 | Cahaly et al. | 439/188 |
| 5,409,403 A | | 4/1995 | Falossi et al. | 439/668 |
| 5,695,357 A | * | 12/1997 | Wright | 439/394 |
| 5,934,924 A | | 8/1999 | Suzuki | 439/318 |
| 5,993,230 A | | 11/1999 | Gauker et al. | 439/188 |
| 6,029,995 A | | 2/2000 | Fink | 280/737 |
| 6,036,226 A | | 3/2000 | Brown et al. | 280/736 |
| 6,077,126 A | | 6/2000 | Peng | 439/668 |
| 6,203,342 B1 | | 3/2001 | Gauker et al. | 439/188 |

* cited by examiner

*Primary Examiner*—Ross Gushi

(57) ABSTRACT

A squib connector assembly comprising a housing having a longitudinal axis and a tip; a female contact disposed within the tip of said housing for mating engagement with a male contact in a mating squib socket; and a ground contact having at least one resilient spring beam disposed on an external surface of the tip of said housing.

18 Claims, 7 Drawing Sheets

ORIENTATIONLESS SQUIB CONNECTOR ASSEMBLY

BACKGROUND OF THE INVENTION

Air bag assemblies are a common safety feature on virtually all motor vehicles of recent vintage. Air bag assemblies comprise an inflatable canister located in the vehicle steering column, dashboard, door panels or seats. In the event of sudden deceleration, the canister is inflated by a gunpowder-based explosive device known as a squib. Sensors located in the vehicle detect the deceleration and fire the squib electronically via signal sent through wires that are attached to the squib via a squib connector assembly. Squib assemblies are also used in other locations in a vehicle, such as in seat belt pretensioner devices, which "lock" the seat belt in position during sudden deceleration.

Many types of squib connector assemblies have been developed. In most case, the assembly must be oriented rotationally relative to the squib socket to ensure that the connector and its mating socket are in the correct clocking position so that proper electrical connections are made. This need to orient the squib connector required that the connector be provided with keying features or other means to ensure that the connector was attached properly.

Also known are squib connectors that do not require the connector to be rotationally oriented in any particular manner relative to the squib socket. See e.g., U.S. Pat. No. 5,993,230. These squib connectors, aptly termed "orientationless" connectors, are preferred because they facilitate the speed and accuracy of manufacture of the squib assembly. In particular, one of the biggest advantages in using orientationless squib connectors is in the installation of the connector into the inflator housing. Use of orientationless connectors saves time and also reduces the potential for squib pin damage during mating. In addition, the orientationless connectors do not requiring keying features, and thus are usually less costly to manufacture than oriented squib connectors.

SUMMARY OF THE INVENTION

In one embodiment, the invention provides a squib connector assembly comprising:

A squib connector assembly comprising:

a) a housing having a longitudinal axis and a tip;

b) a female contact disposed within the tip of said housing for mating engagement with a male contact; and c) a ground contact comprising at least one resilient spring beam disposed on an external surface of the tip of said housing.

Preferably, the connector is of an axial in-line design, meaning that the pair of electrical wires entering the connector assembly are aligned parallel to the longitudinal axis of the connector. In a preferred embodiment, the connector further comprises a ferrite block located within the housing such that lead wires connected to the female and ground terminals pass through the ferrite block.

The housing is preferably of a two-piece design, comprising upper and lower members, with at least one of the upper or lower members including resilient latching means to secure the housing members together. The housing is also preferably provided with external latching tabs to secure the connector in the squib socket.

In a particularly preferred embodiment, the ground contact comprises a circumferential cage having a plurality of resilient spring contacts. In this embodiment, the ground contact is disposed over, and surrounds, the tip of the nose body.

DETAILED DESCRIPTION OF THE EMBODIMENTS

Figure 1:
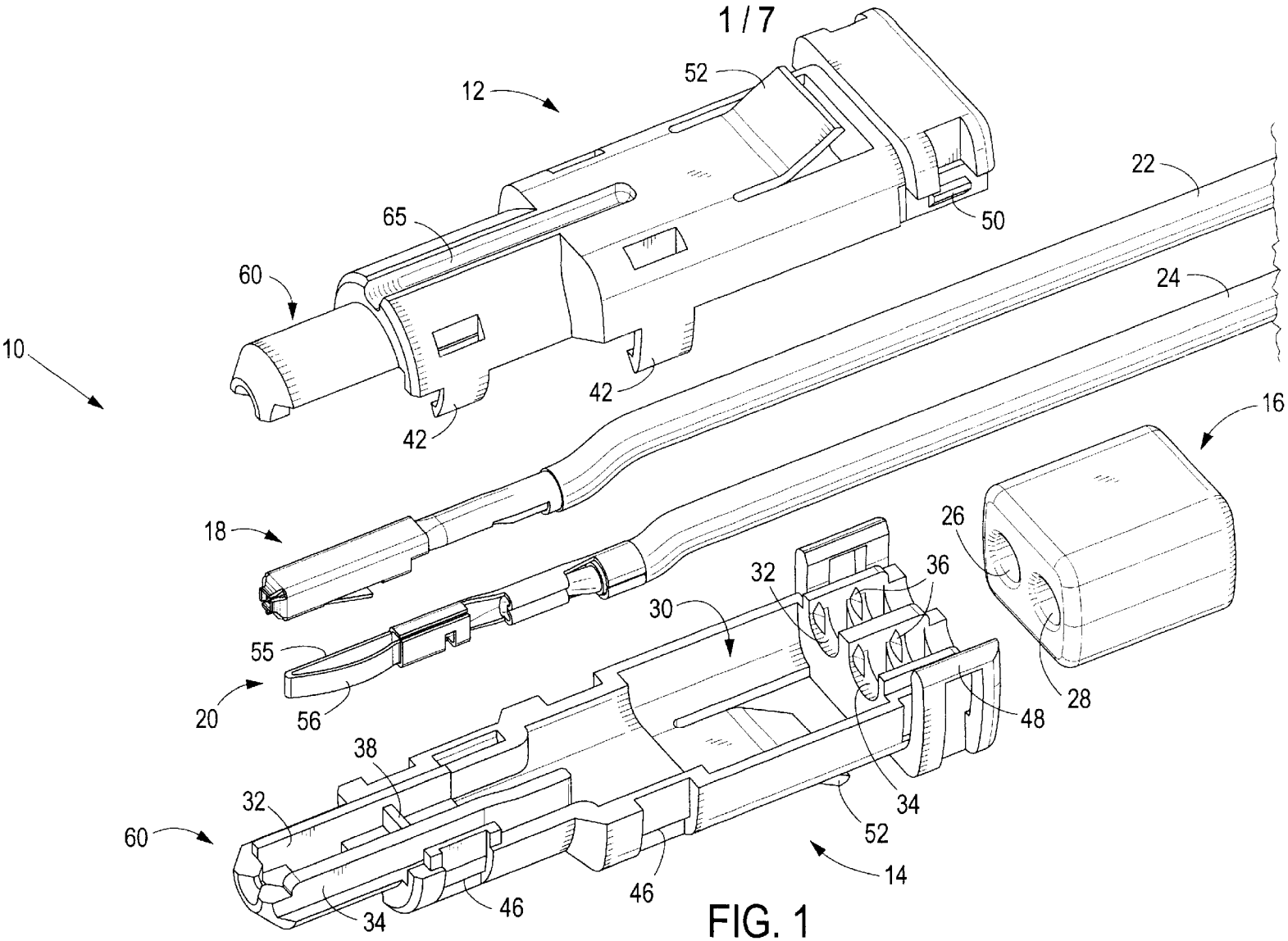
FIG. 1 is an exploded perspective view of one embodiment of the squib connector of the invention.
Figure 2:
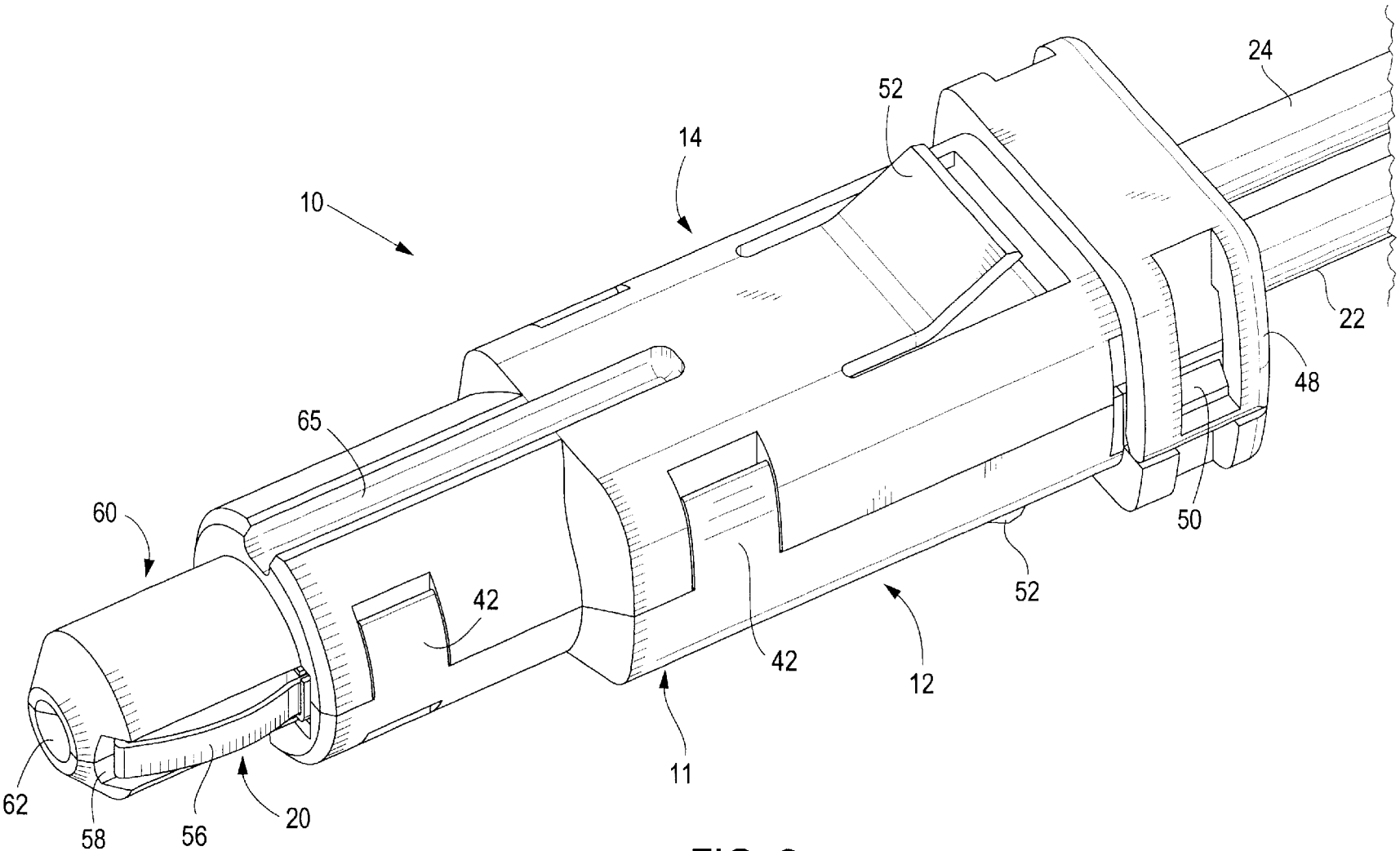
FIG. 2 is a perspective view of the squib connector of FIG. 1, shown fully assembled.
Figure 3:
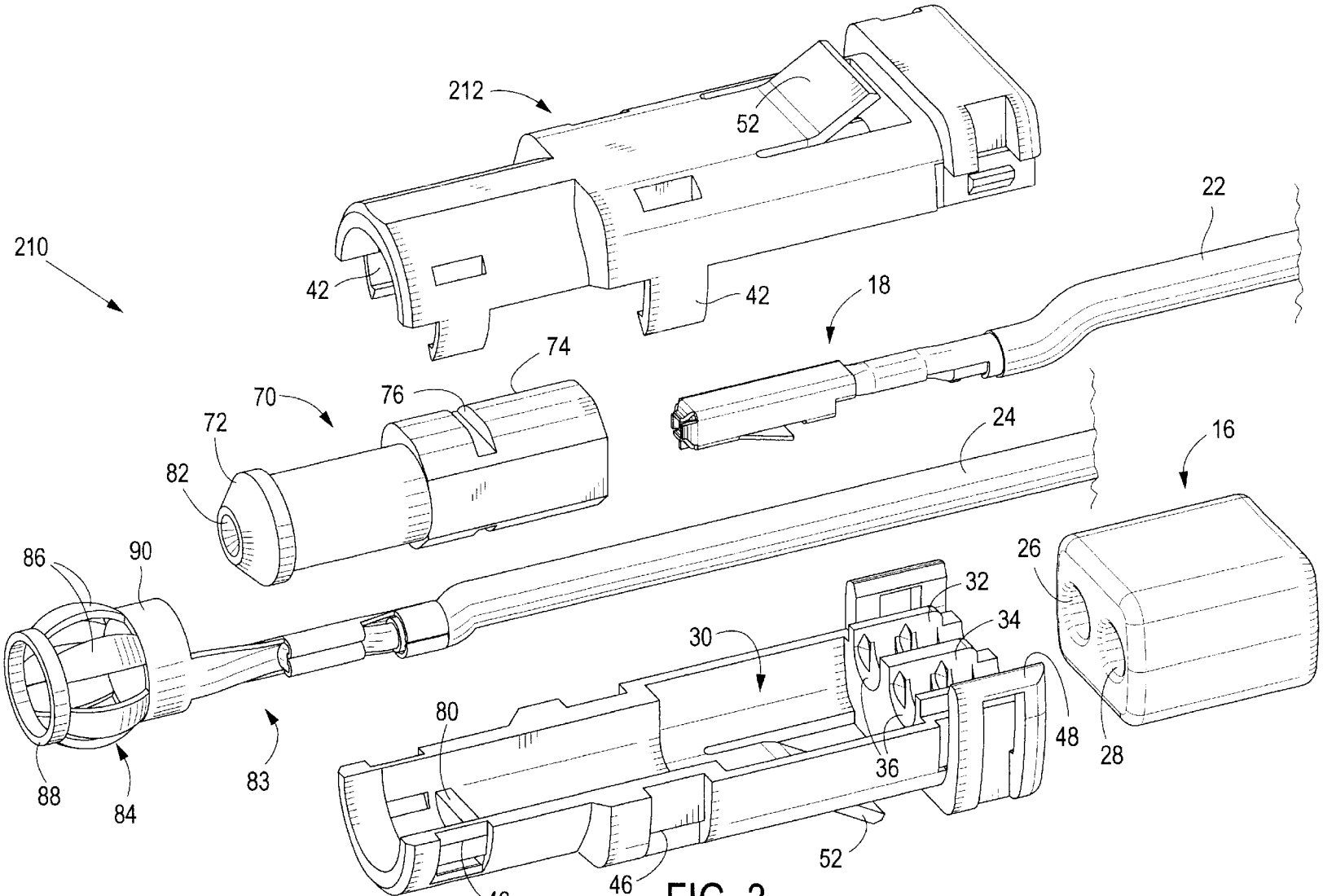
FIG. 3 is an exploded perspective view of a preferred embodiment of the squib connector of the invention.

With reference first being made to FIGS. 1–2, the connector 10 comprises a housing 11, comprising upper housing 12 and lower housing 14, a ferrite block 16, a female contact 18 and a ground contact 20. The female and ground contacts, respectively, terminate electrical conductors or wires 22, 24. The wires 22, 24, as seen in FIGS. 5C–5E, are disposed within respective through holes 26, 28 in the ferrite block 16. The ferrite block 16 is positioned within a cavity 30 in the housing pieces 12, 14. Accordingly, when assembled, the wires 22, 24 are disposed in side-by-side relationship along the longitudinal axis of the connector 10. See FIGS. 5D–5E.

The interior of the housing components 12, 14, as seen in FIG. 1, is provided with wire chases 32, 34 both forward and rearward of the ferrite block cavity 30. The wire chases 32, 34 maintain the side-by-side orientation of the wires 22, 24 in the housing 11. The section of wire chases 32, 34 rearward of the cavity 30 are further provided with stress relieving members 36 to relieve stress on the contacts 18, 20 and on wires 22, 24. In the section of wire chase 32 forward of the cavity 30, a stop boss 38 is provided which prevents female contact 18 from moving into the housing 11 when mated with a male contact, such as pin 40 in the squib socket 300. See FIG. 6.

In order to secure the housing components 12, 14 together, latching tabs 42, 48 are provided on the upper housing 12 and lower housing 14, respectively. Latching tabs 42 cooperate with latching shoulders 46 on the lower housing 14 while latching tab 48 cooperates with latching boss 50 on upper housing 12. It will be appreciated that the number, position and form of latching means to secure the housing components 12, 14 together is not particularly critical to the invention, and other means of securing the housing components 12, 14 together, including the use of adhesives or the like, may be employed and are within the scope of this invention.

Figure 6:
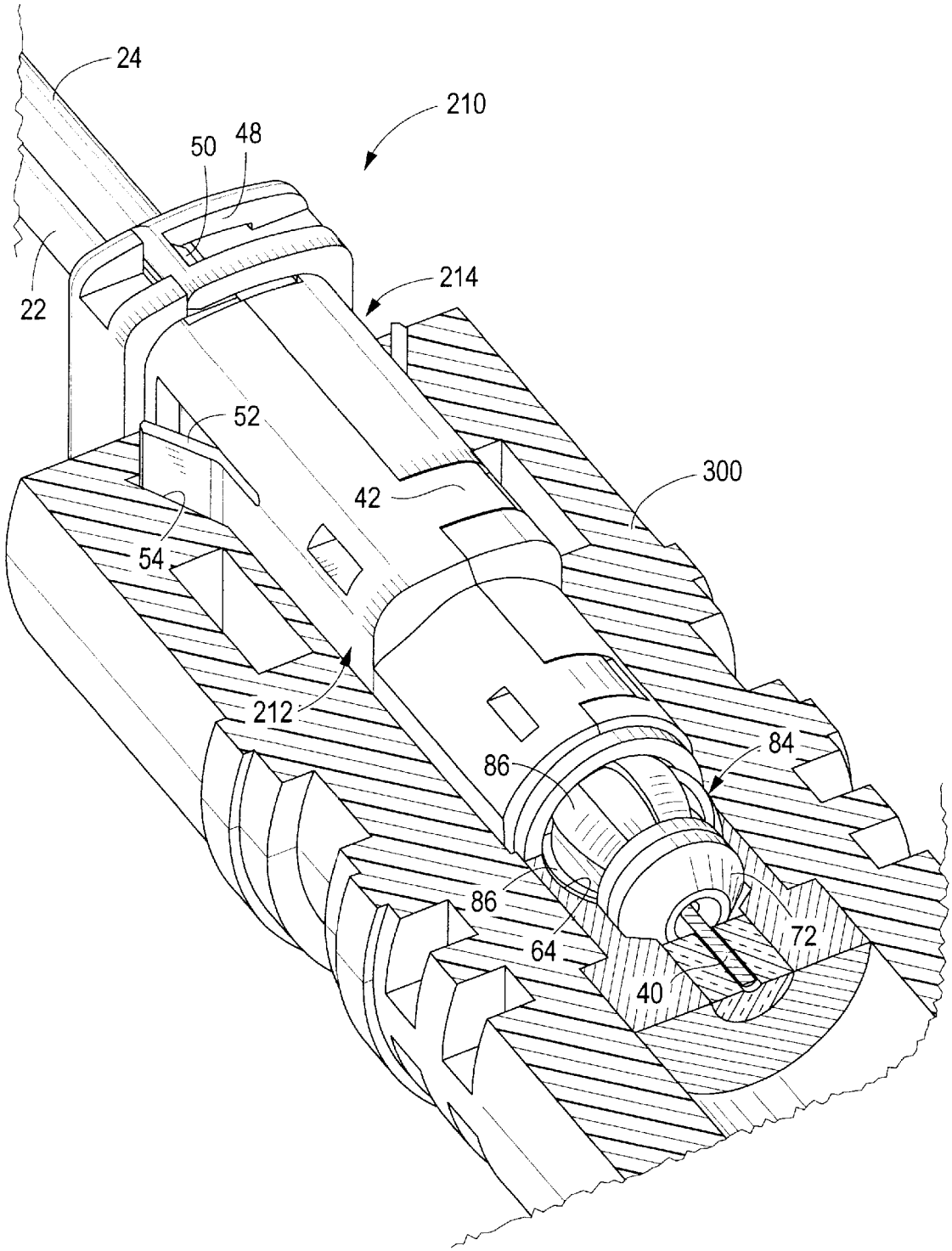
FIG. 6 is a partly sectioned, perspective view of the squib connector of FIG. 3 shown seated in the squib socket.

The housing components 12, 14 are also provided with latching ears 52, one disposed on each of the upper and lower housings 12, 14. As seen in FIG. 6, these latching ears 52 cooperate with notches 54 in the squib socket 300 to maintain the squib connector 10 in position within the socket 300. It will be recognized by those skilled in the art that the housing components 12, 14 may be of molded plastic construction and may be hermaphroditic to reduce manufacturing and inventory costs and to facilitate assembly.

In the embodiment shown in the Figures, the female contact 18 comprises a generally rectangular, box-shaped receptacle that is in electrical and mechanical contact with the conductor of wire 22. Such contacts are well known in the art and need not be discussed in further detail. Examples of such contacts include those described in WO 98/18181 (incorporated herein by reference) and the Micro Quadlok™ System commercially available from Tyco Electronics, Harrisburg, Pa. It will be understood that any suitable female contact may be employed within the scope of the invention.

The ground contact 20, in the embodiment shown in FIGS. 1 & 2, comprises a stamped and formed piece of metal in electrical and mechanical contact with the conductor of wire 24. Ground contact 20, as seen in FIG. 1, has a tongue portion 55 that is folded back upon itself to form a leaf beam 56. The leaf beam 56 has a bow shaped bend, giving the leaf beam a resilient property. As seen in FIG. 2, when the connector 10 is assembled, the leaf beam 56 is disposed within a slot 58 in a nose or tip section 60 of housing 10 and projects beyond the housing 10.

When the squib connector is mated with the squib socket, the electrical power connection is made by male contact 40 (FIG. 6) being engaged with female contact 18 via aperture 62 in nose section 60 of the connector 10. This electrical power connection thus occurs in an orientation that is parallel to the longitudinal axis of the connector 10. The electrical ground connection, which occurs between leaf beam 56 of ground contact 20 and grounding surface 64 located within the squib socket 300 (see FIG. 6). Because the leaf beam 56 projects away from a side surface of the tip 60, it will be appreciated that the ground connection is oriented transverse to the longitudinal axis of the connector and 90 degrees from the power connection. However, the power and electrical connections still occur in planes that are parallel to one another; i.e., the plane of the grounding surface 64 is in spaced, substantially parallel relationship to the plane of the male contact 40. It will also be appreciated that the grounding connection occurs external to the connector 10 while the power connection occurs internal to the connector 10.

In the embodiment shown in FIG. 6, the grounding surface 64 comprises a annular ring that surrounds the tip 60 of the housing 11. It will be understood that alternate arrangements are possible, although not preferred because then orientation of the connector 10 relative to the socket 300 would be required. In the event an oriented arrangement is used, it would be advantageous to provide the housing components 12, 14 with a keyway 65 or other indicia of orientation, as seen in FIGS. 1 & 2.

Turning now to FIGS. 3–6, the preferred embodiment of the squib connector of the invention will be described. It is noted at the onset that the embodiment of FIGS. 1–2 is similar in many respects to the preferred embodiment of FIGS. 3–6 and both share many of the same components. To avoid confusion, the same reference characters will be used for identical components and new reference characters will be used only where the components differ from one embodiment to the other. The description of such components set forth above is equally applicable to the preferred embodiments.

Figure 4:
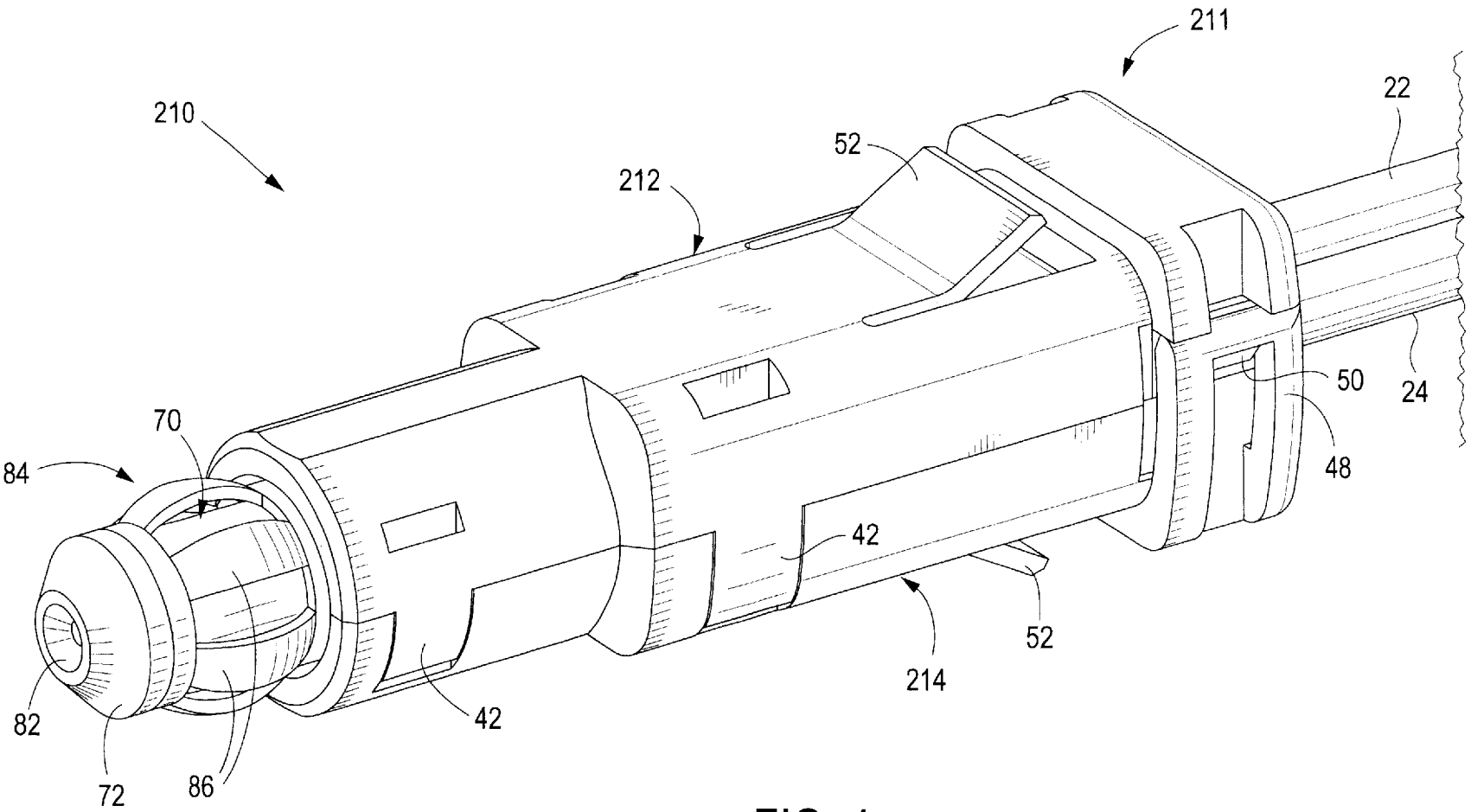
FIG. 4 is a perspective view of the squib connector of FIG. 3, shown fully assembled.

In the preferred embodiment, the connector 210 comprises a housing 211 having upper and lower housing pieces or components 212, 214, respectively and a nose body 70. The nose body 70 is a substantially cylindrical shaped member that, when assembled, is partly disposed in the housing 211. The portion of nose body 70 that is not disposed in the housing 211 extends therefrom to form the tip or nose section of the connector, as shown in FIG. 4. The nose body 70 has a tip 72 and a base 74. The base 74 is provided with slots 76 which cooperate with ribs 80 as a means of retaining the nose body in the housing 211.

As in the previous embodiment, the housing components 212, 214 are provided with latching means 42, 46, 48 and 50 to secure the housing components together, as well as latching ears 52 to secure the squib connector 210 in the squib socket 300. In addition, the housing components 212, 214 are provided with wire chases 32 rearward of the cavity 30 for the ferrite block 16, and the strain relief members 36.

The nose section 70 is provided with a longitudinal bore 82 that is sized to receive therein the female contact 18. The ground contact 83 in the preferred embodiment comprises a cage like member 84 that is mechanically and electrically connected to the conductor of wire 24. The cage 84 comprises a plurality of spaced apart resilient beams 86 arranged in a circular configuration and held together by annular bands 88, 90, one at either end of the beams 86. The cage 84 is sized to fit over the section of nose body 70 that is intermediate the tip 72 and the base portion 74. When assembled, the cage 84 is positioned outside of the housing 211, as seen in FIGS. 4 and 6.

Figure 5A:
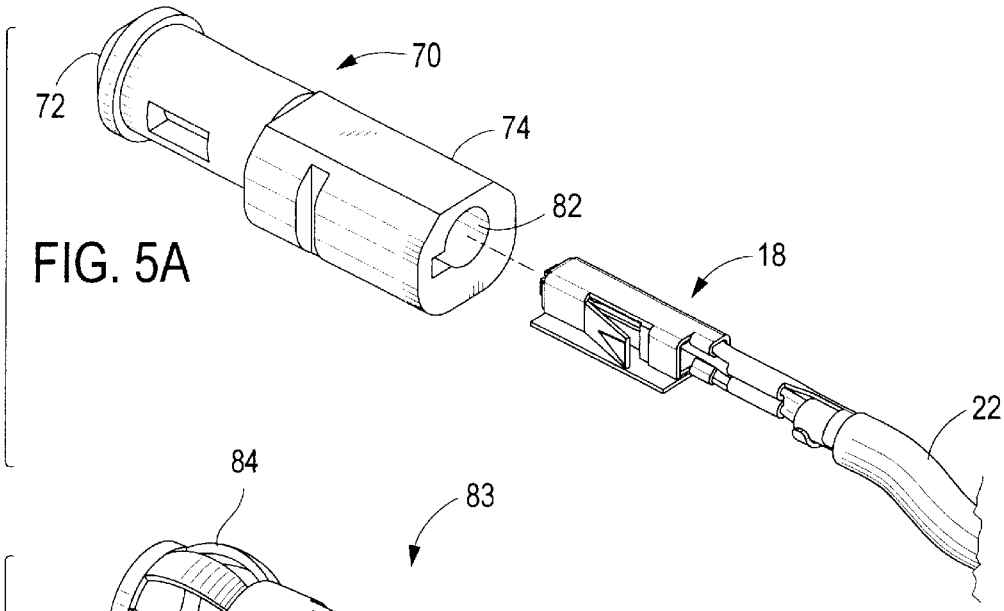
FIGS. 5A–5E are a series of views depicting the assembly of the preferred embodiment of the squib connector of the invention.
Figure 5B:
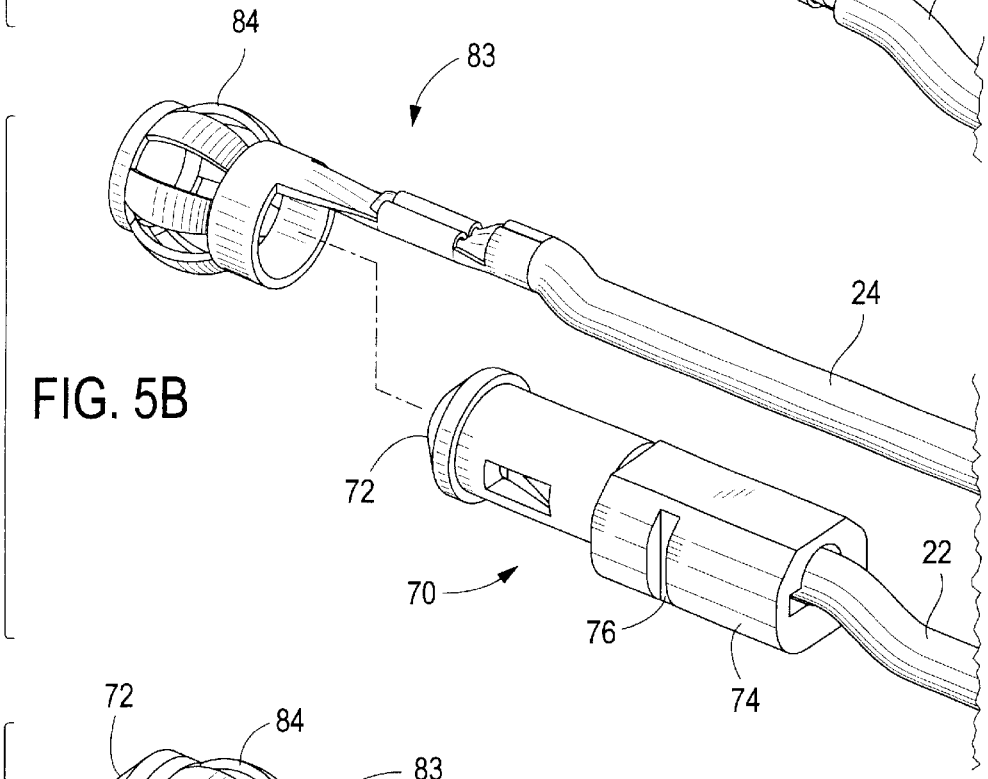
Figure 5C:
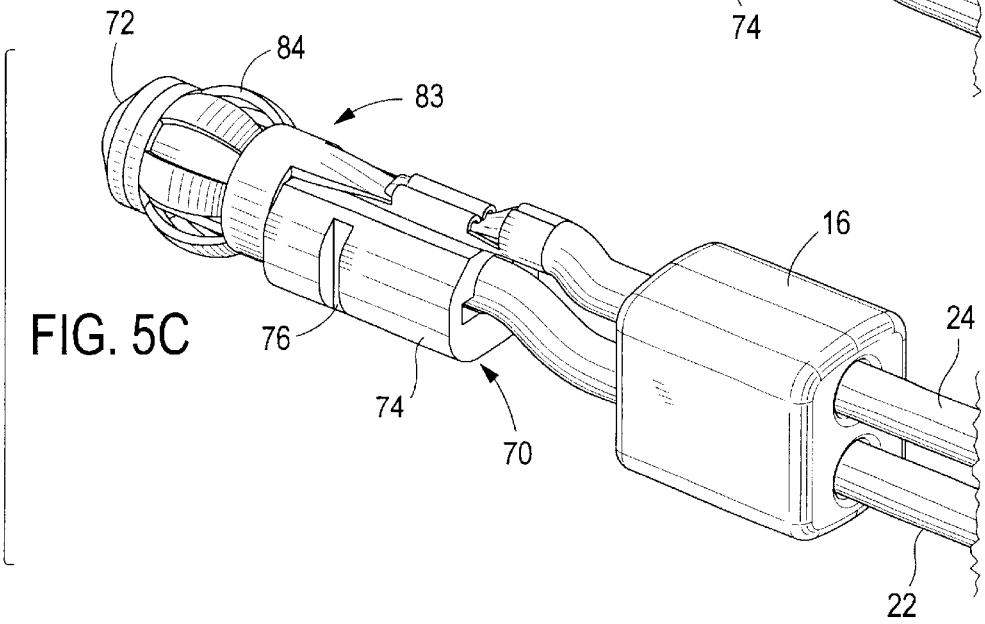
Figure 5D:
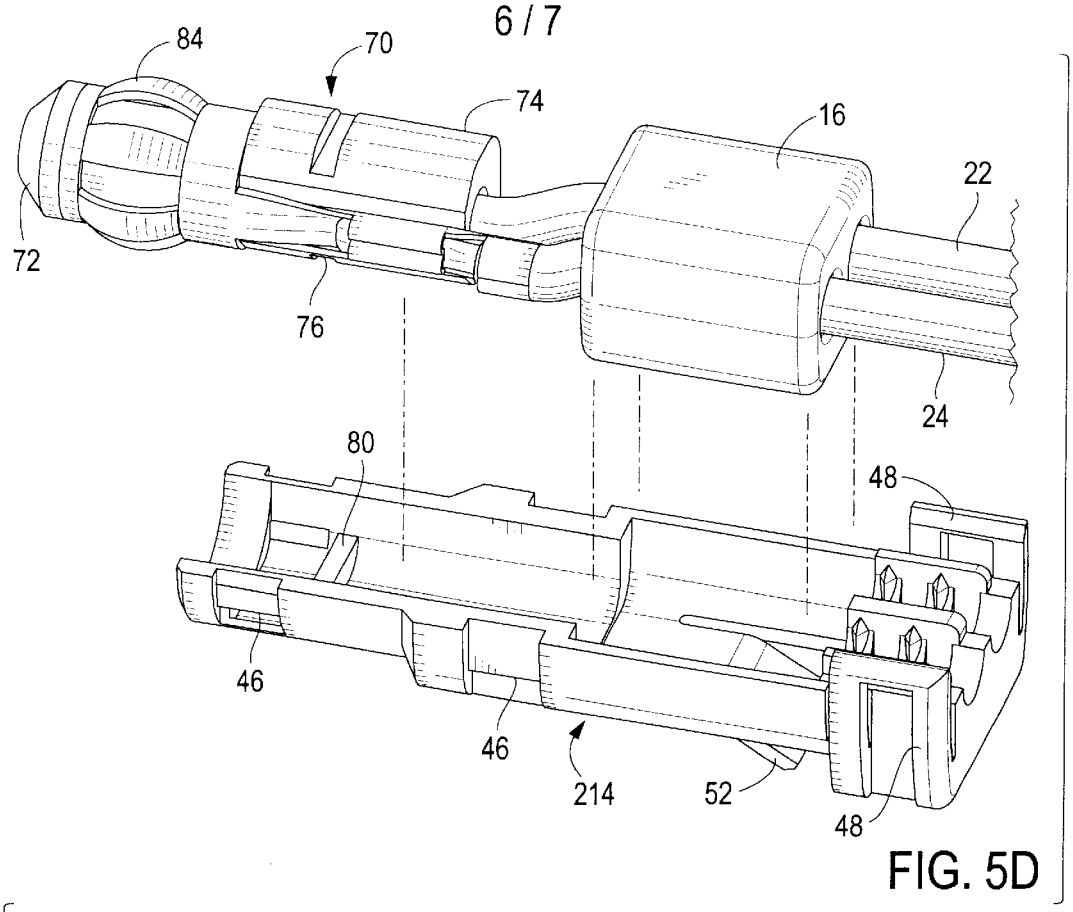
Figure 5E:
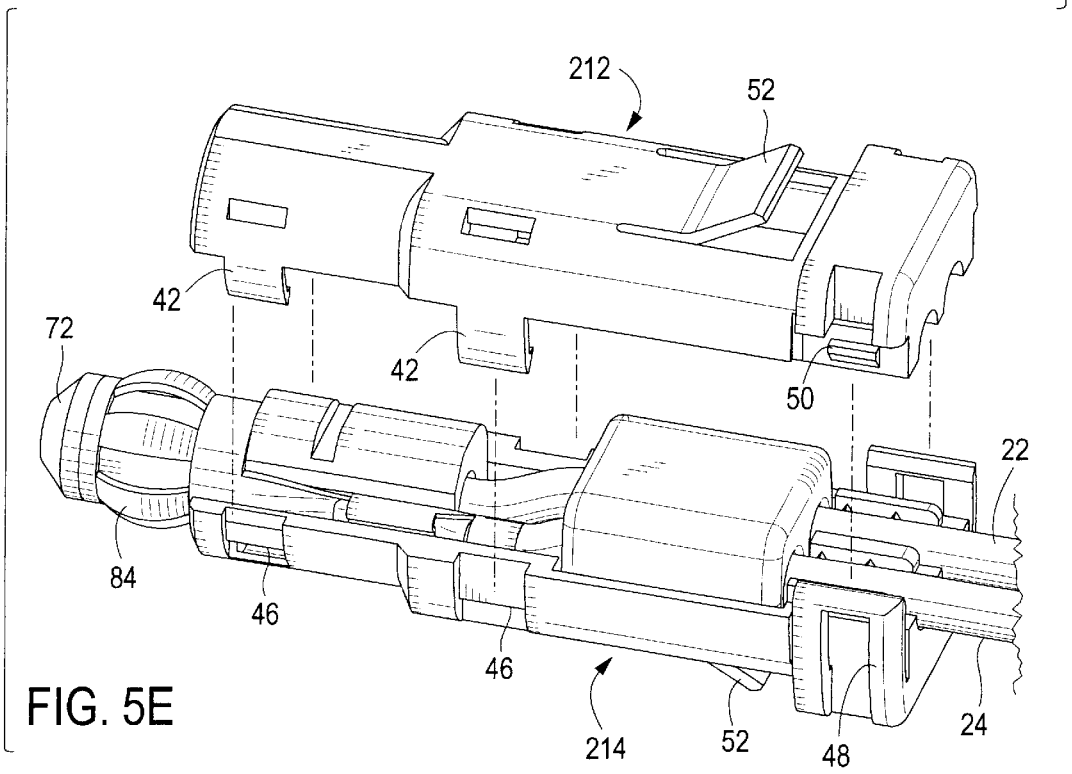

With reference now being made to FIGS. 5A–5E, the assembly of the connector 210 will be described. The following description is for illustration only, and should not be construed in any sense as a limitation on the invention. Those skilled in the art will appreciate that alternate processes are available to assemble the connector. The female contact 18 is mechanically and electrically connected, such as by crimping, to the wire 22. The female contact 18 is then inserted into the longitudinal bore 82 in the nose body 70 from the base end 74 of the nose body. The ground contact 83 is mechanically and electrically connected, such as by crimping, to the wire 24. Then, the tip 72 of the nose body 70 is inserted into the cage 84 of the ground contact 83 as seen in FIG. 5B. The wires 22, 24 are then inserted into the ferrite block 16 as seen in FIG. 5C. The contacts, ferrite block, nose body and wires are then positioned within the housing components 212, 214 and the housing components secured together via latching means 42, 46, 48 and 50. As seen in FIG. 6, the assembled squib connector 210 is then inserted into the squib socket 300 whereby the male contact 40 is mated with the female contact, the ground contact 86 is mated with grounding surface 64 and the latching ears 52 engage the latch recesses 54 to secure the squib connector in position.

We claim:

1. A squib connector assembly comprising:

a) a housing having a longitudinal axis and a tip;

b) an electrical contact disposed within the tip of said housing for mating engagement with a corresponding electrical contact in a squib socket; and c) a ground contact comprising a substantially cylindrical cage having a plurality of spring beams disposed in spaced relation and defining a circumference of said cage;

d) wherein said housing comprises an upper housing, a lower housing and a nose body partially disposed between said upper housing and said lower housing, wherein a portion of the nose body extends beyond the upper and lower housings and comprises said tip.

2. The squib connector of claim 1, wherein the spring beams are positioned along a plane spaced from and substantially parallel to the longitudinal axis of the housing.

3. The squib connector of claim 1, wherein the upper and lower housings are secured together by latching means formed integral with the upper and lower housings.

4. The squib connector of claim 1, said housing comprising latching ears disposed on external surfaces of the housing, said latching ears comprising means for securing the connector in a squib socket.

5. The squib connector of claim 1, further comprising a ferrite block disposed within said housing, said ferrite block being disposed around a portion of a pair of electrical wires, each electrical wire being electrically and mechanically attached to a respective one of said female contact and ground contact.

6. The squib connector of claim 5, wherein the pair of electrical wires are disposed along the longitudinal axis of the housing.

7. A squib connector assembly comprising:

a) a housing having a longitudinal axis and a tip;

b) an electrical contact disposed within the tip of said housing for mating engagement with a corresponding electrical contact;

c) a ground contact comprising at least one resilient spring beam disposed on an external surface of the tip of said housing; and d) a ferrite block disposed in said housing, said ferrite block being disposed around a portion of a pair of electrical wires, each electrical wire being electrically and mechanically connected to a respective one of said electrical contact and said ground contact.

8. The squib connector of claim 7, wherein the ground contact comprises a substantially cylindrical cage having a plurality of spring beams disposed in spaced relation and defining a circumference of said cage.

9. The squib connector of claim 7, wherein the ground contact comprises a single spring beam.

10. The squib connector of claim 7, wherein the at least one spring beam is position along a plane spaced from and substantially parallel to the longitudinal axis of the housing.

11. The squib connector of claim 7, wherein said housing comprises an upper housing, a lower housing and a nose body partially disposed between said upper housing and said lower housing, wherein a portion of the nose body extends beyond the housing and comprises said tip.

12. The squib connector of claim 7, said housing comprising latching ears disposed on external surfaces of the housing, said latching ears comprising means for securing the connector in a squib socket.

13. The squib connector of claim 7, wherein the housing comprises an upper housing and a lower housing secured together.

14. The squib connector of claim 13, wherein the upper and lower housings are secured together by latching means formed integral with the upper and lower housings.

15. A squib connector assembly comprising:

a) a housing having a longitudinal axis and a tip;

b) a female contact disposed within the tip of said housing for mating engagement with a male contact; and c) a ground contact consisting of a single resilient spring beam disposed on an external surface of the tip of said housing.

16. The squib connector of claim 15, wherein the housing comprises an upper housing and a lower housing secured together.

17. The squib connector of claim 16, wherein the upper and lower housings are secured together by latching means formed integral with the upper and lower housings.

18. The squib connector of claim 15, further comprising a ferrite block disposed within said housing, said ferrite block being disposed around a portion of a pair of electrical wires, each electrical wire being electrically and mechanically attached to a respective one of said female contact and ground contact.

* * * * *